US010259687B2

(12) United States Patent
Myers et al.

(10) Patent No.: US 10,259,687 B2
(45) Date of Patent: Apr. 16, 2019

(54) END CAP AND SPREADER BAR SYSTEM AND METHOD FOR SIZING SAME

(71) Applicant: Clayton P. Myers, Webster, TX (US)

(72) Inventors: Clayton P. Myers, Webster, TX (US); Timothy I. McCullough, Katy, TX (US)

(73) Assignee: Clayton P. Myers, Webster, TX (US)

( * ) Notice: Subject to any disclaimer, the term of this patent is extended or adjusted under 35 U.S.C. 154(b) by 0 days.

(21) Appl. No.: 15/918,632

(22) Filed: Mar. 12, 2018

(65) Prior Publication Data

US 2018/0201482 A1 Jul. 19, 2018

Related U.S. Application Data

(63) Continuation-in-part of application No. 15/249,001, filed on Aug. 26, 2016, now Pat. No. 9,914,623, which is a continuation of application No. 15/053,856, filed on Feb. 25, 2016, now Pat. No. 9,469,509.

(51) Int. Cl.
*B66C 1/10* (2006.01)
*B66C 1/12* (2006.01)

(52) U.S. Cl.
CPC . *B66C 1/10* (2013.01); *B66C 1/12* (2013.01)

(58) Field of Classification Search
CPC .... B66C 1/12; B66C 1/18; B66C 1/24; B66C 1/10
USPC ..... 294/81.1, 81.5, 74
See application file for complete search history.

(56) References Cited

U.S. PATENT DOCUMENTS

| | | | | |
|---|---|---|---|---|
| 3,911,960 | A | 10/1975 | Flimon | |
| 4,215,891 | A | 8/1980 | Thiele | |
| 4,397,493 | A | 8/1983 | Khachaturian et al. | |
| 4,538,849 | A * | 9/1985 | Khachaturian | B66C 1/12 294/81.1 |
| 4,842,315 | A | 6/1989 | Bellow | |
| 5,603,544 | A | 2/1997 | Bishop et al. | |
| 5,863,085 | A | 1/1999 | Khachaturian | |

(Continued)

FOREIGN PATENT DOCUMENTS

GB WO2007/102002 A2 9/2007

OTHER PUBLICATIONS

Tandemloc, Inc., Spreader Bar End Cap Assembly "End Caps" (AC25C Type), 2 pages.

(Continued)

*Primary Examiner* — Stephen A Vu

(57) ABSTRACT

Several embodiments of an end cap are provided for use with a spreader bar system for distributing the lift force of a load across multiple points. The end cap includes a receptacle shaped to receive the spreader bar. The receptacle comprises an outer end and a pinch bolt located on an outer surface of the receptacle. A load plate abuts the outer end of the receptacle, and is reinforced by a brace. A lifting lug extends from the load plate and has at least a first aperture. The aperture is shaped to receive a corresponding shackle that is configured to connect to a sling for lifting the spreader bar. A visual indicator on a surface of the lifting lug and positioned between the first aperture and the load plate defines a predetermined minimum angle between the spreader bar and the sling when the spreader bar is lifted via the sling.

20 Claims, 11 Drawing Sheets

(56) References Cited

U.S. PATENT DOCUMENTS

| | | | |
|---|---|---|---|
| 6,079,760 | A | 6/2000 | Khachaturian |
| 7,222,903 | B2 | 5/2007 | Tardiff |
| 7,533,699 | B1 | 5/2009 | Cellemme et al. |
| 7,967,352 | B2 | 6/2011 | Di Martino |
| 8,011,391 | B2 | 9/2011 | Heritier et al. |
| 8,118,091 | B2 | 2/2012 | Baker et al. |
| 8,468,877 | B2 | 6/2013 | Molloy |
| 9,132,993 | B1 | 9/2015 | DiMartino |
| 2009/0072561 | A1 | 3/2009 | Latham |
| 2012/0160359 | A1 | 6/2012 | Baker et al. |

OTHER PUBLICATIONS

Tandemloc, Inc., Standard Spreader Pipe for Use With AC25C End Eye Caps (AC22P), 2 pages.

* cited by examiner 145a
138a
140a
143a
136a
130a
132a
106
126
120
137
143b
132b
130b
136b
138b
145b
140b 140a
145a
138a
121
123a
106
143a
108
146a
150a
132b
130b
137
138b
150b
140b
143b
134b
120
146b 140a
143a
134a
138a
120
146a
150a
130a
137
132a
123b
145a
145b
108
121

140b
145b
138b
120
137
146b
130b
136b
150b
106
108
130a
126
128
121
123b

Legend

Inside Diameter:

$ID := OD - 2 \cdot t_W$ $\quad ID = 6.07 \cdot in$

Section Modulus:

$S_p := \pi \cdot \frac{(OD^4 - ID^4)}{32 \cdot OD}$ $\quad S_p = 8.5 \cdot in^3$ Area of Section:

$A_{sect} := \frac{\pi}{4}(OD^2 - ID^2)$ $\quad A_{sect} = 5.58 \cdot in^2$

Radius of Gyration:

$r := \sqrt{\frac{I_p}{A_{sect}}}$ $\quad r = 2.25 \cdot in$

MOI:

$I_p := \pi \cdot \frac{(OD^4 - ID^4)}{64}$ $\quad I_p = 28.14 \cdot in^4$

Linear Weight:

$\omega_p := A_{sect} \cdot \rho$ $\quad \omega_p = 19.02 \cdot \frac{lbf}{ft}$

*Box 1*

For Compression Loads

$K := 1.0$ Effective Length Factor for pin-pin K=1

Slenderness ratio $S_e := \frac{K \cdot L_{sprd}}{r} = 98.2$

Column Slenderness ratio separating elastic and inelastic buckling $C_c := \sqrt{\frac{2 \cdot \pi^2 \cdot E}{F_y}} = 127.9$

*Box 2A*

For Kl/r < $C_c$

$$F_{a_1} := \frac{\left[1 - \frac{(S_e)^2}{(2 \cdot C_c^2)}\right] \cdot F_y}{N_d \cdot \left[1 + \frac{9 \cdot (S_e)}{40 \cdot C_c} - \frac{3 \cdot (S_e)^3}{40 \cdot C_c^3}\right]} = 7.22 \cdot ksi$$

*Box 2B*

For Kl/r > $C_c$

$$F_{a_2} := \frac{\pi^2 \cdot E}{1.15 \cdot N_d \cdot (S_e)^2} = 8.6 \cdot ksi$$

*FIG. 9A*

*Box 3*

Actual Column Stress: $f_a := \dfrac{\dfrac{P}{\tan(\beta)}}{A_{sect}} = 5.38 \cdot ksi$

*Box 4*

For Bending Loads

Allowable: $F_b := \dfrac{F_y}{N_d} = 11.67 \cdot ksi$

Bending moment due to weight of pipe $M_b := \dfrac{\omega_p \cdot L_{sprd}^2}{8} + x = 9633.52 \cdot lbf \cdot in$ (if an additional bending moment exists, then it can be input as x)

Actual Bending Stress $f_b := \dfrac{M_b}{S_p} = 1.13 \cdot ksi$

*Box 5*

Pipe Combined Stresses

Check $S_e$ vs. $C_c$

Allowable Stress $$F_a := \begin{cases} F_{a_2} & \text{if } \dfrac{K \cdot L_{sprd}}{r} > C_c \\ F_{a_1} & \text{otherwise} \end{cases}$$

$C_c = 127.89 \qquad \dfrac{K \cdot L_{sprd}}{r} = 98.2$ $F_a = 7.22 \cdot ksi \qquad C_m := 1.0$ Euler Stress for a prismatic member divided by a design factor $$F_e := \frac{\pi^2 \cdot E}{1.15 N_d \cdot S_e^2} = 8.6 \cdot ksi$$

*Box 6*

Unity Check

This number must be less than or equal to 1.0. If not, design parameters must be changed to comply with ASME BTH-1 2011. Both equations must be satisfied.

$$\frac{f_a}{\dfrac{F_y}{N_d}} + \frac{f_b}{F_b} = 0.56 \qquad \frac{f_a}{F_a} = 0.74 \qquad \frac{C_m \cdot f_b}{\left(1 - \dfrac{f_a}{F_e}\right) \cdot F_b} = 0.26 \qquad \frac{f_a}{F_a} + \frac{C_m \cdot f_b}{\left(1 - \dfrac{f_a}{F_e}\right) \cdot F_b} = 1$$

*FIG. 9B*

END CAP AND SPREADER BAR SYSTEM AND METHOD FOR SIZING SAME

RELATED APPLICATIONS

This application is a continuation-in-part of U.S. patent application Ser. No. 15/249,001 filed on Aug. 26, 2016, which is a continuation and claims the benefit of pending U.S. patent application Ser. No. 15/053,856 filed on Feb. 25, 2016, the entireties of which are incorporated herein by this reference.

FIELD

Embodiments within the scope of this disclosure relate, generally, to apparatuses, systems, and methods for fitting tubulars or pipes as spreader bars onto a shackle or lifting sling. This is accomplished through the use of an "end cap" fitting, which keeps the tubular in a compressive state and allows the tubular to be quickly and easily attached and disconnected from the lifting system without material alteration.

BACKGROUND

The use of spreader bar systems for lifting tubulars is well-known in the art. Examples of such spreader bar systems include, e.g., U.S. Pat. No. 4,397,493 to Khachaturian, et al., and U.S. Pat. No. 5,603,544 to Bishop, et al. The advantage of these systems is that they allow the force of a single-point lifting system, such as a shackle or hook, to be divided into multiple lifting points, thus avoiding the material stress and safety concerns associated with lifting a heavy load by a single point.

In order to adapt the shackle and spreader bar systems for various dimensions and weights, it is common to utilize an "end cap" system (also known as a compression cap system) for attaching spreader bars to the shackle. In this system, the spreader bar is fitted between two "end caps," which contain multiple orifices for connecting to both the lifting mechanism above and the load below. This allows for quick swapping of various sizes and weights of spreader bar as necessitated by the lift.

However, there are still several drawbacks to the state of the art in spreader bar lifting. Assembly of the end cap requires precise alignment of the end cap with the spreader bar, and often requires a tubular spreader bar to be physically altered (e.g., through spot welds or attachment holes) which can weaken the spreader bar's tolerance for metallurgical stresses.

Additionally, the process of determining the correct end cap fitting for use with a given load and span of weight to be lifted can often be time-consuming and prone to error when calculated by workers in the field. This can lead to an increased stress on the equipment and the risk of lift failure.

A need therefore exists for an end cap system in which both the method of selecting a properly rated and sized end cap and the physical method of fixing the end cap to a selected spreader bar are simplified to allow field personnel to more quickly and reliably rig-up lifting systems. Embodiments disclosed in the present invention meet these needs.

BRIEF DESCRIPTION OF THE DRAWINGS

In the detailed description of various, example embodiments within the scope of the present disclosure, reference is made to the accompanying drawings, in which:

FIG. 9A depicts a series of equations used to derive pre-calculated tolerances for the end cap described in the present invention.

FIG. 9B depicts a series of equations used to derive pre-calculated tolerances for the end cap described in the present invention.

One or more embodiments are described below with reference to the above-listed Figures.

DETAILED DESCRIPTION OF THE EMBODIMENTS

Before describing selected, example embodiments of the present disclosure in detail, it is to be understood that the present invention is not limited to the particular embodiments described herein. The disclosure and description herein is illustrative and explanatory of one or more example embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood the drawings are intended to illustrate and disclose presently example embodiments to one of skill in the art, but are not intended to he manufacturing level drawings or renditions of final products, and may include simplified conceptual views as desired for easier and quicker understanding or explanation.

As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Figure 1:
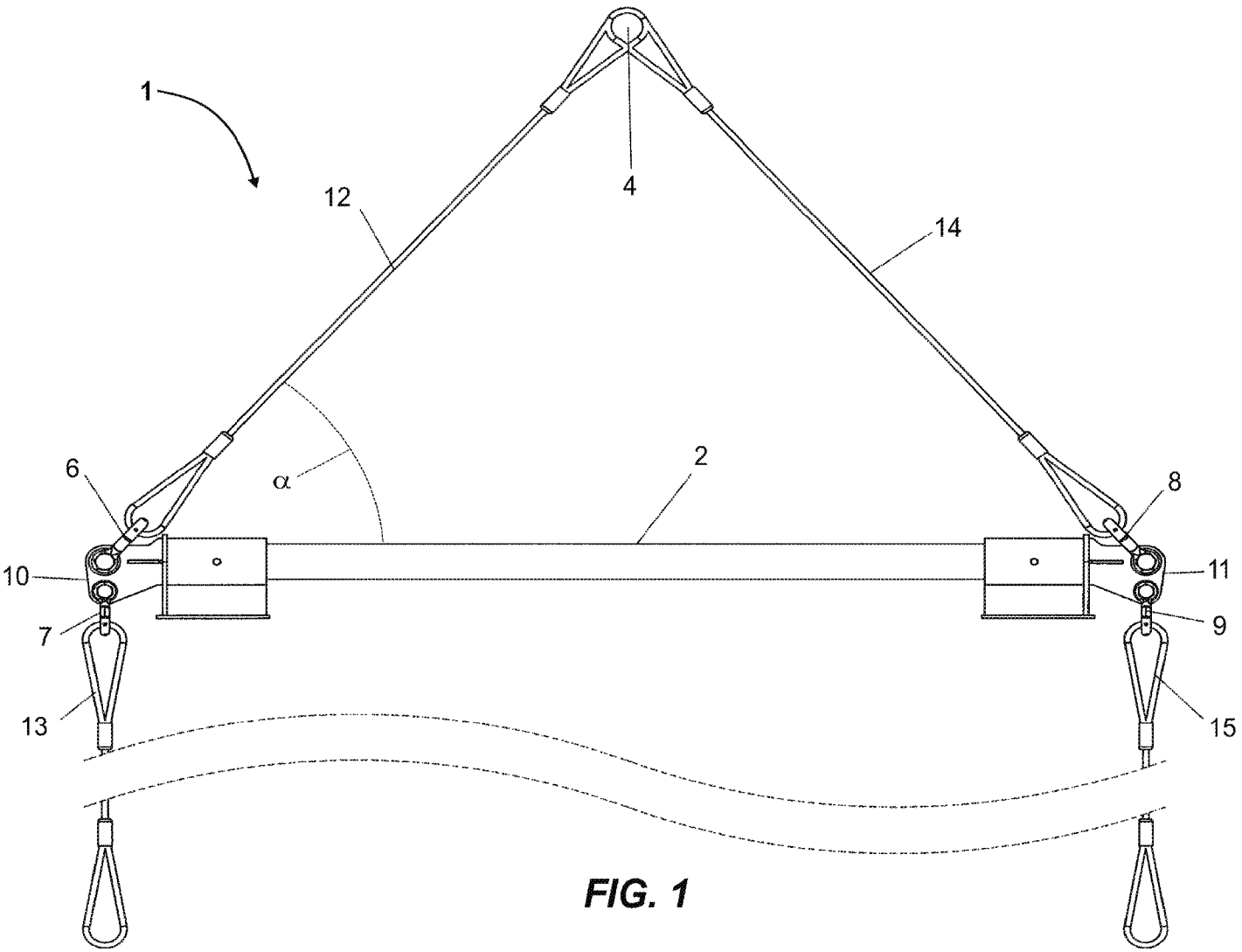
FIG. 1 depicts the overall layout of an embodiment of the end cap system in the context of connections to a single-point lift and a load to be lifted.

Referring now to FIG. 1, a lifting assembly 1 utilizing an embodiment of two end caps 10, 11 is illustrated. Lifting assembly 1 comprises spreader bar 2, lift point 4, and four shackles 6, 7, 8, 9. Shackles 6, 8 are connected by slings 12, 14 to lift point 4, while shackles 7. 9 are connected by slings 12, 14 to a weight to be lifted (not shown). Optimally, the relationship between the slings 12, 14 and the spreader bar 2 are defined by a minimum angle (also known as a fleet angle), shown as a, so as to keep the compressive force exerted on the spreader bar 2 within a maximum tolerance.

Figure 2:
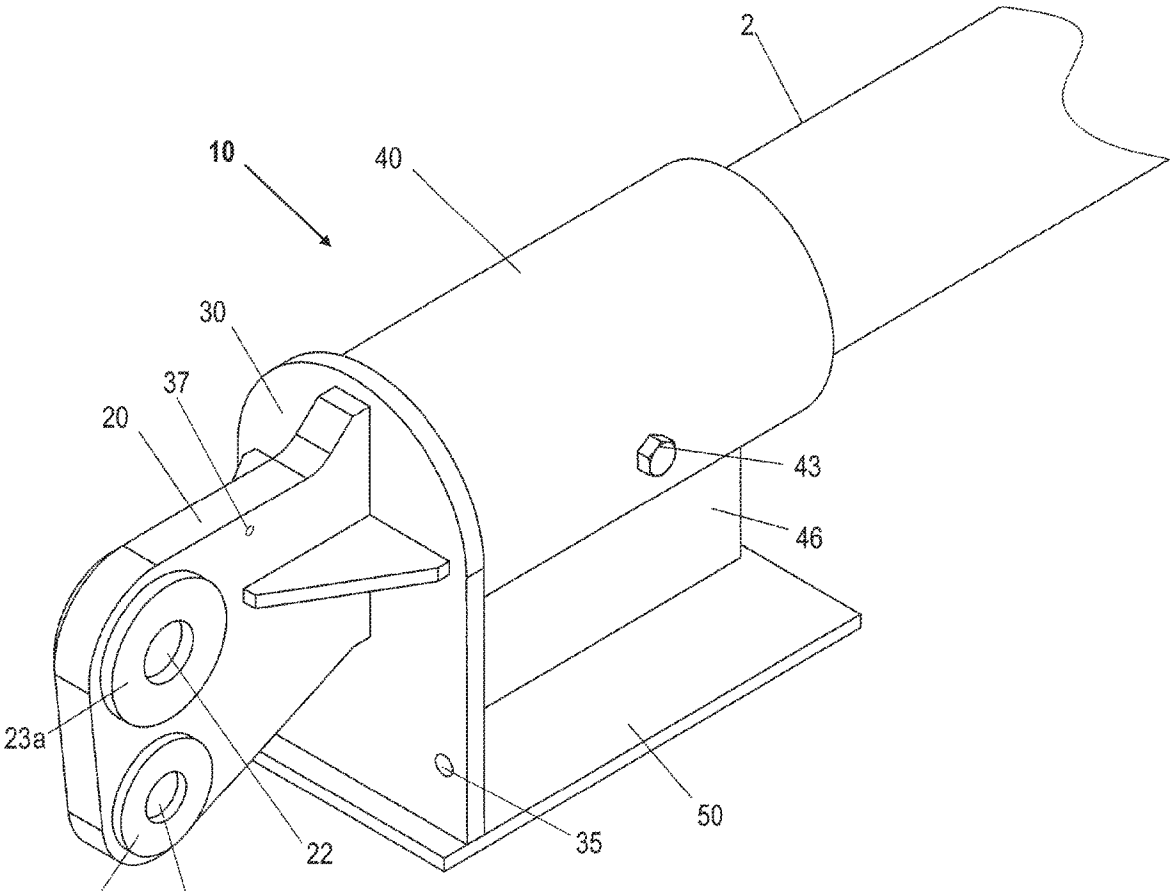
FIG. 2 depicts an embodiment of the end cap described in the present invention in perspective view.

Referring now to FIG. 2, the embodiment of the end cap 10 illustrated in FIG. 1 is shown in greater detail. End cap 10 comprises a load lug 20 extending longitudinally from a load plate 30. Load lug 20 in turn comprises two apertures 22, 24, which accommodate the shackles 6, 7 (not shown, illustrated in FIG. 1). To reinforce the strength of the material, apertures 22, 24 are reinforced through pairs of cheek plates 23A, 23B, and 25A, 25B, respectively (B plates not visible).

Load plate 30 faces a first end of spreader bar 2, which is compressed against load plate 30 and extends through a pipe retainer, also known as receptacle, 40, which extends from load plate 30 in the opposite longitudinal direction from load lug, also known as lifting lug, 20. In this embodiment, pipe retainer 40 is a hollow cylinder through which spreader bar 2 can be fitted. Pipe retainer 40 also comprises two apertures 42, 44 (not visible) through which two retaining bolts, also known as pinch bolts, 43, 45 (45 not visible) extend to compress against spreader bar 2. Retaining bolts 43, 45, allow the use of intact pipe for spreader bar 2, rather than pipe which has had holes torched through it, thereby compromising the material stress properties thereof.

Extending downward from pipe retainer 40 and norm to load plate 30 is leg plate 46, which terminates at foot plate 50. Leg plate 46 and foot plate 50 allow the end cap 10 to be easily mounted to spreader bar 2 in parallel with another end cap 11 (see FIG. 1).

Additionally, end cap 10 comprises two alignment references. Alignment aperture 35 is located through load plate 30 and serves to align two end caps (e.g., end caps 10 and 11 as depicted in FIG. 1) when in use. Angle reference 37, meanwhile, is located on load lug 20 and serves as a visual safety reference to keep the angle of the shackles 6, 8 and slings 12, 14 (depicted in FIG. 1) at a minimum effective angle.

Figure 4A:
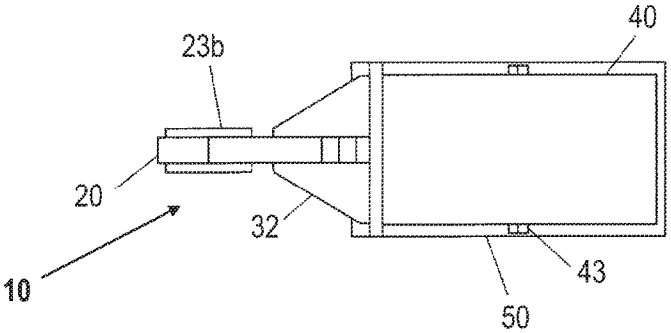
FIG. 4A depicts an embodiment of the end cap described in the present invention in a plan (overhead) view.
Figure 4B:
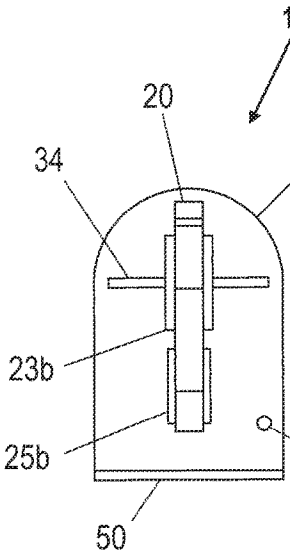
FIG. 4B depicts an embodiment of the end cap described in the present invention in a left side view.
Figure 4C:
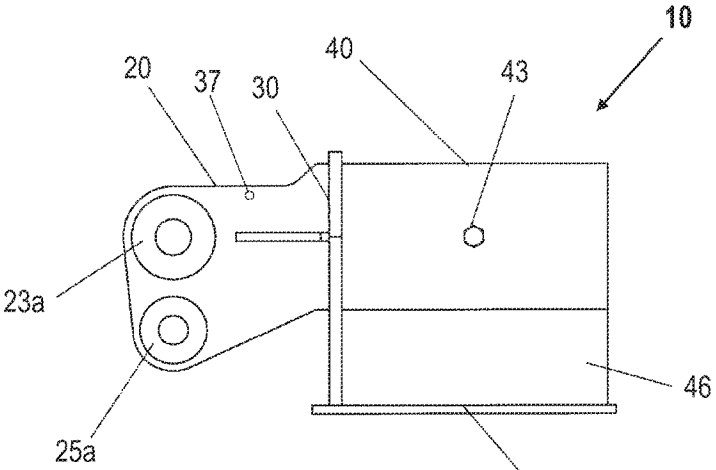
FIG. 4C depicts an embodiment of the end cap described in the present invention in a side-on view.
Figure 4E:
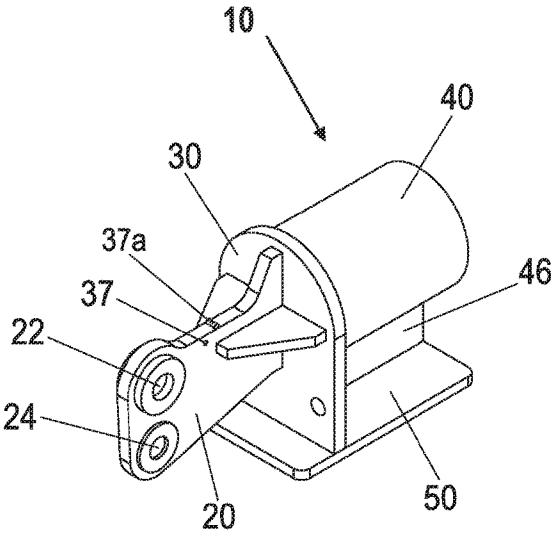
FIG. 4E depicts an additional embodiment of the end cap described in the present invention in perspective view.

In the present embodiment, angle reference 37 is depicted as a second aperture, however, it may be appreciated that other embodiments may include a simple surface reference (e.g., a reflector), a round steel bar (as shown in FIG. 4E), or alternatively, a protruding physical stop. Any feature which serves to visually or physically mark the minimum effective angle (depicted as $\alpha$ in FIG. 1) between slings 12, 14 and spreader bar 2 may be utilized without departing from the scope of this invention. In an example embodiment, the minimum effective angle is a 45 degree angle, which is specifically referenced in the associated chart for this specific system but may differ in other embodiments.

Figure 3:
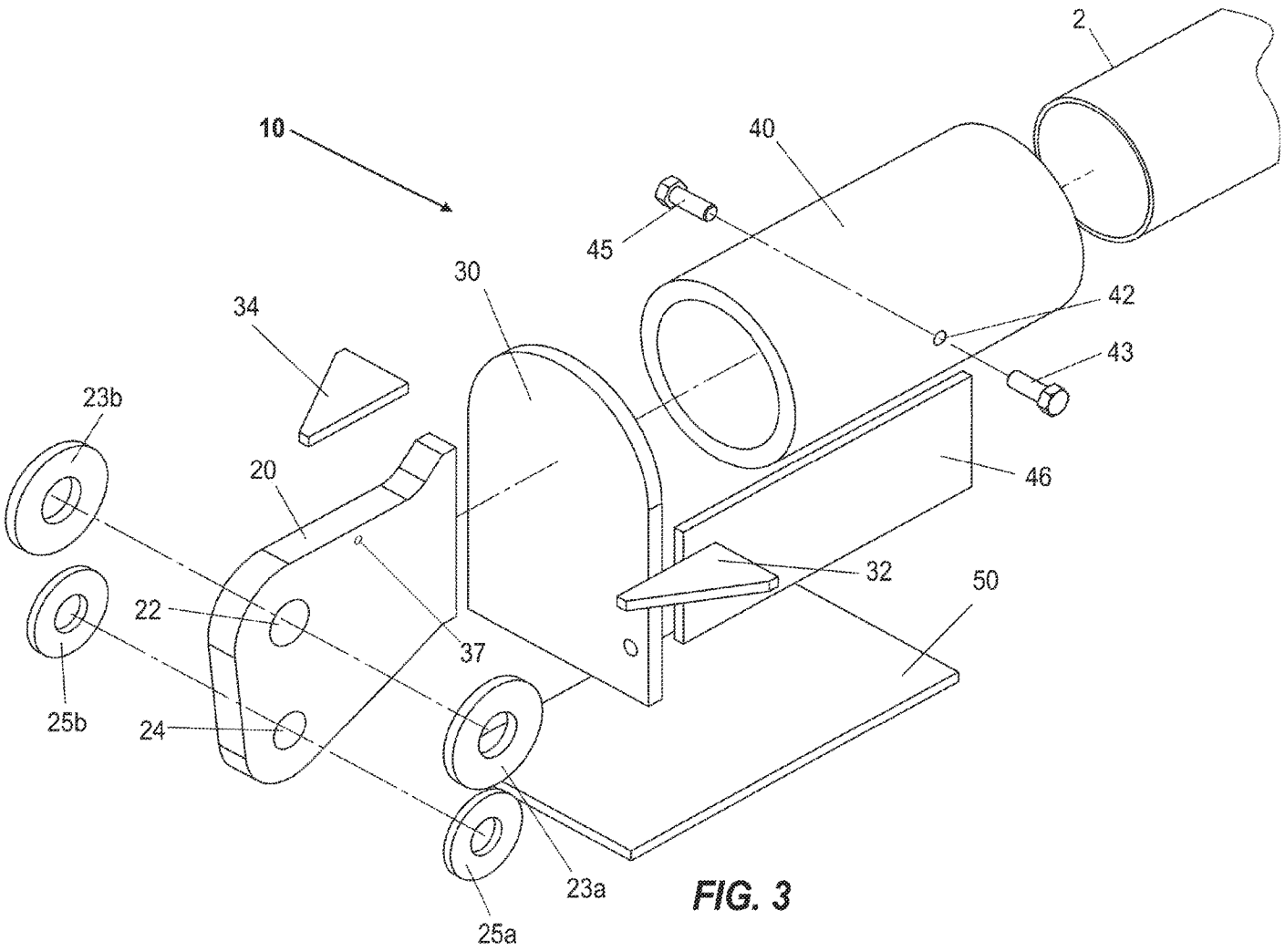
FIG. 3 depicts an embodiment of the end cap described in the present invention in an exploded view.

Referring now to FIG. 3, the embodiment of the end cap 10 illustrated in FIGS. 1-2 is shown in an exploded view. Retaining bolt 45, aperture 42, and cheek plates 23B, 25B are visible in this view. Additionally, braces 32, 34 are also illustrated, which brace load plate 30 against load lug 20.

Figure 4F:
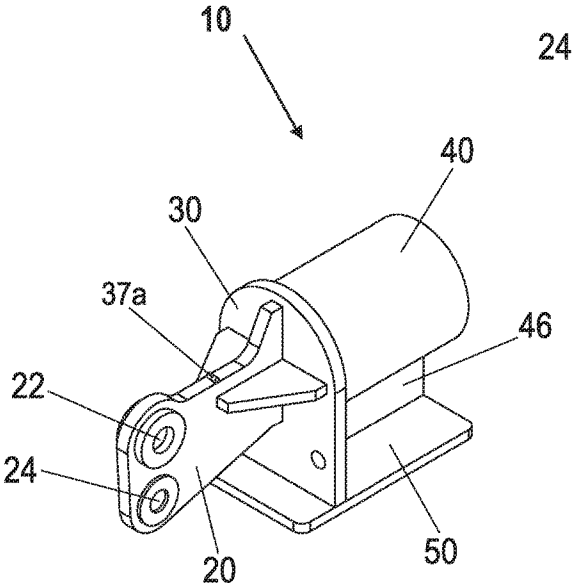
FIG. 4F depicts an alternative embodiment of the end cap described in the present invention in perspective view.
Figure 4D:
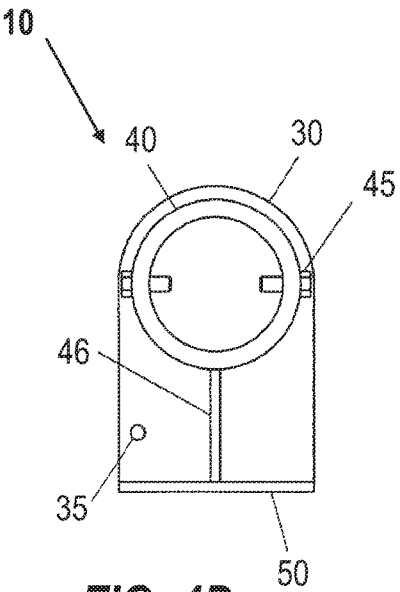
FIG. 4D depicts an embodiment of the end cap described in the present invention in a right side view.

FIG. 4A-4D show embodiments of the end cap 10 illustrated in FIGS. 1-3. FIG. 4A shows the end cap 10 in an overhead plan view. FIG. 4B shows a left side view of the end cap 10. FIG. 4C illustrates a side-on view of the end cap 10, and FIG. 4D shows a right side view of the end cap 10. Significantly, the side views in FIGS. 4B and 4D illustrate how alignment aperture 35, which is located on load plate 30, may ensure that two end caps are properly aligned when mounted onto a spreader bar, as one end cap 10 will be in the position illustrated by FIG. 4B and the other in the position illustrated by FIG. 4D. Aperture 35 can also be used for a connection or "tag" line used with an adjoining rope or line to allow the spreader bar system to be guided from a safe distance from the load that is being lifted. The end caps 10 disclosed within the scope of the disclosure include embodiments having end caps 10 that vary in size and shape from the end cap 10 of FIG. 3. For example, FIG. 4E shows an embodiment of the end cap 10 that has a lifting lug 20 that is longer and thus extends the apertures 22, 24 further from the brace load plate 30. This longer lifting lug 20 may enable a greater variance in the types of fasteners that may be connected to the apertures 22, 24. For example, a larger range of rigging applications such as braided slings, thimble eye slings, synthetic slings, or other larger-diameter fasteners may be used with the lifting lug 20 shown in FIG. 4E. The lifting lug 20 may also include a bar 37*a* as an angle reference. In the embodiment of FIG. 4E, the bar 37*a* is included with the angle reference 37 that is on a side of the lifting lug 20. In a preferred embodiment shown in FIG. 4F, the angle reference 37 is omitted, so that the bar 37*a* on a top surface of the lifting lug 20 is the only angle indicator on the lifting lug 20.

The bar 37*a* may be placed at a location to indicate a minimum for the fleet angle a, such that if the bar 37*a* is not visible from the side of the end cap 10, then the fleet angle $\alpha$ is too small for the designed lifting assembly 1. The bar 37*a* may be constructed of a wide variety of materials including steel or other metals, ceramics, polymers, or others. The bar 37*a* is not limited to a particular shape, and may have a variety of different shapes without deviating from its function. In one embodiment, the bar 37*a* is a round bar, e.g., cylindrically shaped, as shown in FIG. 4E. In other embodiments, the bar 37*a* may have a rectangular shape, a pentagonal shape, a hexagonal shape, an octagonal shape, a decagonal shape, a pyramid shape, a ball shape, a prism shape, or other polygonal shape. The bar 37*a* may be welded, glued, or otherwise attached to a top side of the lifting lug 20. Alternatively, the bar 37*a* may be a protrusion of the lifting lug 20 itself.

Figure 5:
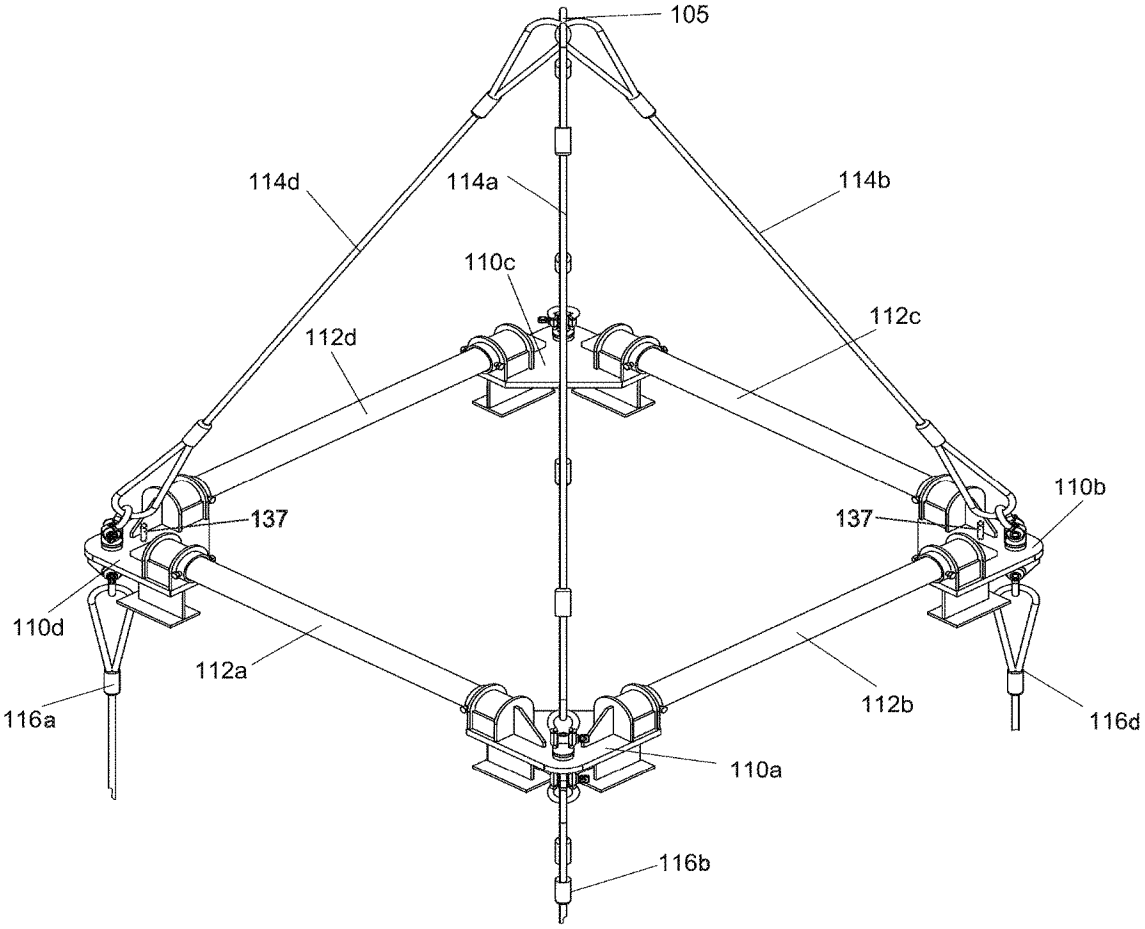
FIG. 5 depicts the overall layout of an embodiment of the end cap system in the context of connections to a multi-point lift and a load to be lifted.

While all of the embodiments thus shown are directed to two-point lifts, it can be appreciated that the principles of the invention can also apply to more elaborate lifting systems. FIG. 5 illustrates a perspective view of another embodiment of the invention: an end cap system directed to four-point lifts rather than two-point lifts.

Continuing with FIG. 5, the depicted embodiment comprises a plurality of end caps 110*a*-*d*, connected by a plurality of spreader bars 112*a*-*d*, wherein each end cap

110*a-d* is connected by an upper sling 114*a-d* (114*c* not visible) connecting to a common lift point 105, and a lower sling 116*a-d* (116*c* not visible) connected to a load to be lifted (not visible). Each of the end caps 110*a-d* in the embodiment may include an angle indicator 137 to indicate a minimum for the fleet angle α between the slings and the spreader bars, as discussed in the earlier embodiments.

Figure 6:
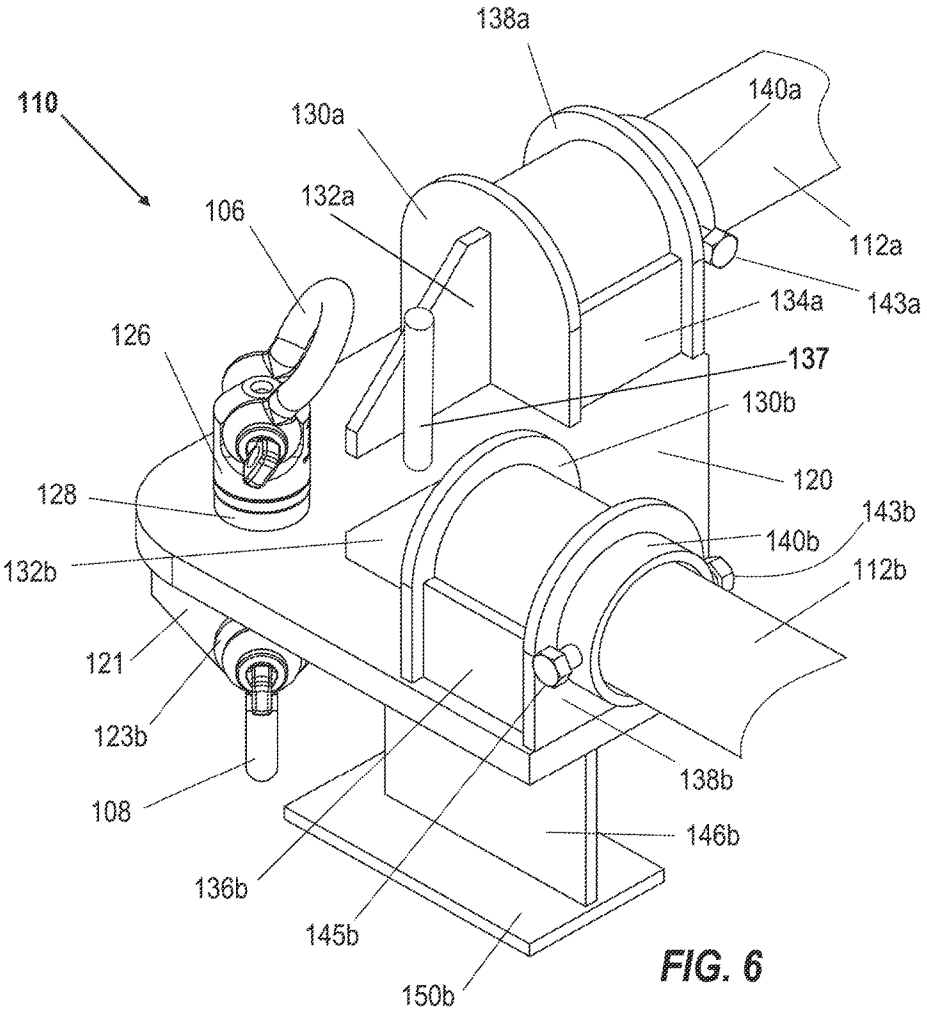
FIG. 6 depicts an embodiment of the end cap described in the present invention in perspective view.
Figure 7:
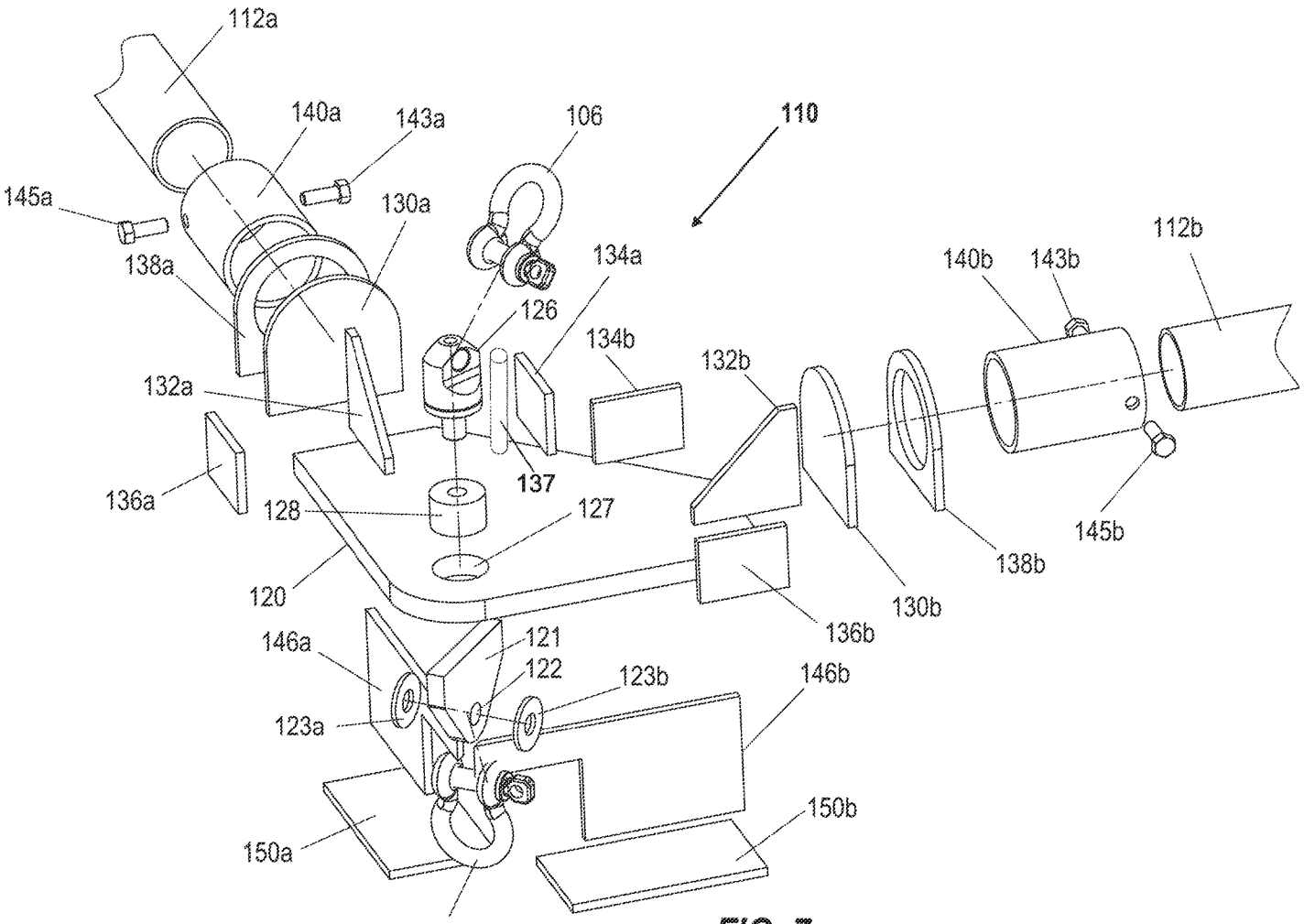
FIG. 7 depicts an embodiment of the end cap described in the present invention in an exploded view.
Figures 8A, 8B, 8C, 8D:
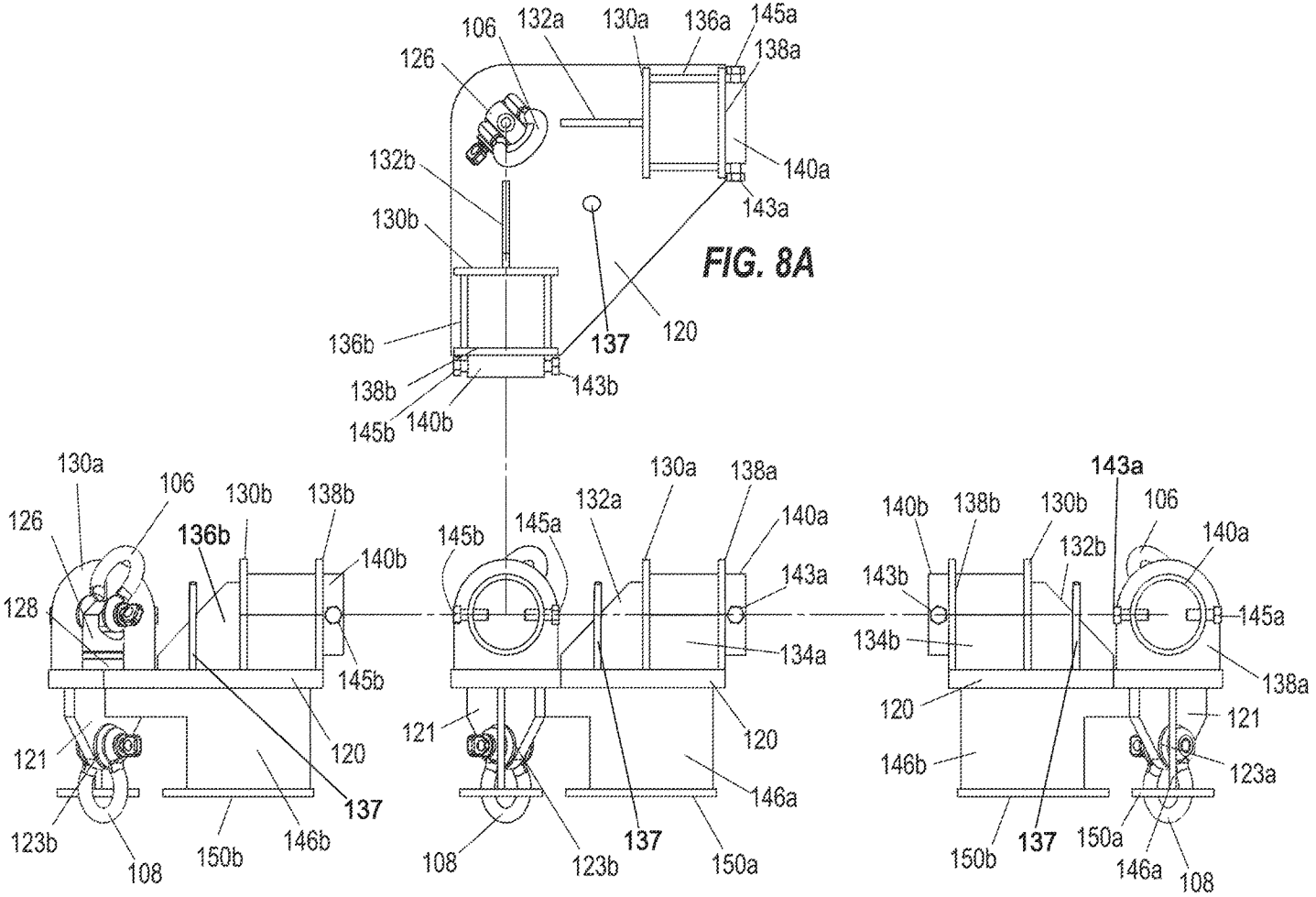
FIG. 8A depicts an embodiment of the end cap described in the present invention in a plan (overhead) view.
FIG. 8B depicts an embodiment of the end cap described in the present invention in a outward-facing longitudinal view.
FIG. 8C depicts an embodiment of the end cap described in the present invention in a side view.
FIG. 8D depicts an embodiment of the end cap described in the present invention in an inward-facing longitudinal view.

Turning now to FIG. 6 and FIG. 7, these drawings depict a perspective view and exploded view, respectively, of an embodiment of the four-point end cap 110. End cap 110 comprises mounting plate 120, and similar to the embodiment shown in FIG. 1-4, additionally comprises load plates 130*a* 130*b*, pipe retainers 140*a*, 140*b*, and feet plate 150*a*, 150*b* (150*a* not visible in FIG. 6). Pipe retainers 140*a*, 140*b* enclose spreader bars 112*a*, 112*b*, respectively. Pipe retainers 140*a*, 140*b* are supported in place by load plates 130*a*, 130*b*, as well as support braces 132*a*, 132*b* inside braces 134*a-b* (134*b* not visible in FIG. 6), outside braces 136*a-b* (136*a* not visible in FIG. 6), and mounts 138*a*, 138*b*. In addition to compression forces, pipe is fixed in place through retaining pinch bolts 143*a*, 143*b* and 145*a*, 145*b* (145*a* not visible in FIG. 6).

In this embodiment, upper and lower shackles 106 and 108 are connected to mounting plate 120 via two different means. Upper shackle 106 is connected to swivel ring 126, which is connected to mounting plate 120 via a ring bushing 128 seated in an aperture 127 (shown in FIG. 7). Lower shackle 108 is connected to lifting lug 121, a structure that partially duplicates the structure depicted in the embodiment of FIGS. 1-4, with an aperture 122 through which shackle 108 can be attached and reinforced by cheek plates 123*a*, 123*b*.

Additionally, as with the embodiment depicted in FIGS. 1-4F, this embodiment comprises two horizontal foot plates 150*a*, 150*b*, which, in turn, are connected to mounting plate 120 via two vertical leg plates 146*a*, 146*b*. Moreover, the mounting plate 120 of the lifting lug 121 may include the angle indicator 137 (shown in FIGS. 5, 6, 7 and 8A-8D) to indicate a minimum for the fleet angle α between the slings and the spreader bars, as discussed above. The angle indicator 137 may be attached to a surface of the mounting plate 120 as shown in FIGS. 5-8D.

Turning now to FIGS. 8A-8D, the embodiment shown in FIGS. 5-7 is depicted in overhead, front, side, and rear views, similar to those of FIG. 4A-4E for the previous embodiment. (Note that FIGS. 8B and 8C can be distinguished by the position of lower shackle 108 with respect to the face-on foot plate 150*a* or 150*b*.)

Turning now to FIGS. 9A and 9B, a method of calculation is disclosed whereby the design parameters of various embodiments of the present invention can be pre-calculated from the load and span required in a lifting job. In this method, the load is purely compressive, i.e., the horizontal resultant is aligned with the pipe centerline. The exemplar calculations shown are for a load of 30 tons having a span of 20 ft to be lifted using a spreader bar of cylindrical pipe, made of standard ASTM A53B carbon steel.

The material parameters used in the calculation are as follows: Minimum yield ($F_y$, 35 ksi), density (ρ, 0.284 lbf/in3), modulus of elasticity (E, 29,000 ksi), outside diameter (OD, 6.625 in), wall thickness ($t_w$, schedule 40). Additionally, the spreaders in this calculation are presumed to be 9.75 inches in length, making the unbraced insert length ($L_{sprd}$) 220.5 in (span minus two spreaders).

From the above material parameters, several secondary parameters can be deduced, such as inside diameter (ID), area of section ($A_{sect}$), MOI ($I_p$), section modulus ($S_p$), radius of gyration (r), and linear weight ($\omega_p$), using the formulas at the top of FIG. 9A. Additionally, a design parameter ($N_d$) is given in ASME BTH-1 2005, which for the purposes of the exemplar calculation is 3.0 (Category B).

Box 1, two compression load factors are calculated: a slenderness ratio, and a column slenderness ratio separating elastic and inelastic buckling, using the formulas given in Box 1. Depending on which of the two results is greater, the allowable column stress can be calculated using the formulas in Box 2A and Box 2B, while the actual column stress can be calculated using the formula in Box 3.

Meanwhile, the allowable and actual bending load stresses can be calculated using the formulas in Box 4. Then, the allowable and actual combined (Euler) stresses can be calculated utilizing the formulas in Box 5.

Finally, a two-part unity check is performed utilizing the values derived in Box 3, Box 4, and Box 5, and plugging them into the equations of Box 6.

While the exemplar calculations are given for a load of 30 tons having a span of 20 ft, it should be appreciated that these calculations may be performed in advance for any number of specific weights and spans. In addition, other parameters such as diameter, thickness, and weight of the end caps may also vary while still remaining within the scope of the present disclosure. In a method embodiment, the maximum tolerance for a given weights and span is pre-calculated and placed in a chart having weights and spans corresponding to different scales of end cap (e.g., diameter, thickness), for field workers to quickly and reliably select an embodiment of the present invention having dimensions which tolerate the lift stresses of a given task.

While various embodiments usable within the scope of the present disclosure have been described with emphasis, it should be understood that within the scope of the appended claims, the present invention may be practiced other than as specifically described herein.

What is claimed is:

1. An end cap for use with a spreader bar, the end cap comprising:

a receptacle shaped to receive the spreader bar, the receptacle comprising an outer end and at least one pinch bolt extending through an outer surface of the receptacle to contact a surface of the one spreader bar;

a load plate abutting the outer end of the receptacle, a lifting lug extending from the load plate and having at least a first aperture therethrough, wherein said first aperture is shaped to receive a corresponding shackle, and the shackle is configured to connect to a sling for lifting the spreader bar; and a visual indicator on a surface of the lifting lug and positioned between the first aperture and the load plate to define a predetermined minimum angle between the spreader bar and the sling when the spreader bar is lifted via the sling.

2. The end cap of claim 1, wherein the visual indicator is a bar.

3. The end cap of claim 1, wherein the visual indicator is an aperture.

4. The end cap of claim 1, wherein the predetermined minimum angle is 45 degrees.

5. The end cap of claim 1, further comprising:

a foot plate located below the receptacle, the load plate, and at least a portion of the lifting lug, wherein the foot plate is flat, and wherein the foot plate has a perpendicular connection with the load plate.

6. The end cap of claim 5, further comprising a leg plate connecting the foot plate to the receptacle.

7. The end cap of claim 1, wherein the load plate is reinforced by at least one brace.

8. The end cap of claim 1, wherein the load plate is reinforced by at least two braces, wherein one brace of the at least two braces connects the load plate to the lifting lug, and the other brace of the at least two braces is alongside and parallel with the receptacle.

9. The end cap of claim 1, wherein the load plate comprises at least one aperture therethrough.

10. The end cap of claim 1, wherein the lifting lug comprises a second aperture to receive a second corresponding shackle.

11. The end cap of claim 10, wherein the lifting lug comprises at least two cheek plates, wherein one of the at least two cheek plates is concentric to the first aperture, and wherein the other of the at least two cheek plates is concentric to the second aperture.

12. The end cap of claim 1, wherein the lifting lug comprises at least one cheek plate located concentric to the first aperture.

13. A system for lifting a load with at least one spreader bar and at least two end caps, the system comprising:

the at least one spreader bar extending between the two end caps, wherein each end cap comprises a lifting lug, and a receptacle to receive an end of the at least one spreader bar, and wherein each receptacle comprises a pinch bolt adapted to contact a surface of the at least one spreader bar to fasten the end of the at least one spreader bar into place;

a plurality of lower shackles, wherein each of the plurality of lower shackles is connected at a first end thereof to the lifting lug of one of the two end caps, and is connected at a second end thereof to a lower sling, and wherein the lower sling is adapted to connect to the load;

a plurality of upper shackles, wherein each of the plurality of upper shackles is connected at a first end thereof to the lifting lug of one of the two end caps, and is connected at a second end thereof to an upper sling, and wherein the upper sling is adapted to connect to a lift point, a surface of the lifting lug of each of the two end caps includes a visual indicator defining a predetermined minimum angle between the at least one spreader bar and the upper sling when the spreader bar is lifted via the upper sling.

14. The system of claim 13, wherein the visual indicator is a bar.

15. The system of claim 13, wherein the visual indicator is an aperture.

16. The system of claim 13, wherein the minimum angle is 45 degrees.

17. The system of claim 13, wherein each of the two end caps comprises a foot plate, wherein the foot plates of the two of end caps are aligned in a common plane that is parallel with the at least one spreader bar.

18. The system of claim 13, wherein the each receptacle is reinforced by a plurality of braces.

19. The system of claim 13, wherein the each of the two end caps comprises an aperture therethrough, wherein the apertures of the two end caps align to define a common line therethrough when ends of the at least one spreader bar are inserted into a respective receptacle of the two end caps, and wherein the common line is parallel with the at least one spreader bar.

20. An end cap for use with a spreader bar, the end cap comprising:

a receptacle shaped to receive the spreader bar, the receptacle comprising an outer end;

a lifting lug extending from the receptacle and including a front portion, a back portion abutting the receptacle, two opposing side surfaces extending between the front portion and the back portion, and a top surface connecting the two opposing side surfaces, the two opposing side surfaces comprising an aperture for receiving a corresponding shackle, wherein the shackle is configured to connect to a sling for lifting the spreader bar; and a visual indicator on the top surface of the lifting lug and positioned between the aperture and the receptacle, wherein the visual indicator indicates that:

(i) an angle between the spreader bar and the sling is too small to maintain a compressive force on the spreader bar within a predetermined tolerance, when the spreader bar is lifted via the shackle and the sling and the shackle hides the visual indicator as viewed from one of the two opposing side surfaces of the lifting lug; and (ii) the angle between the spreader bar and the sling is large enough to maintain the compressive force on the spreader bar within the predetermined tolerance, when the spreader bar is lifted via the shackle and the sling and the shackle does not hide the visual indicator as viewed from one of the two opposing side surfaces of the lifting lug.

* * * * *